United States Patent [19]

Paul et al.

[11] Patent Number: 4,660,992

[45] Date of Patent: Apr. 28, 1987

[54] WATCH WITH REMOVABLE FACE

[75] Inventors: Gary Paul, 36 Gilbert Ave., Paramus, N.J. 07652; Bert Paul, Paramus, N.J.

[73] Assignee: Gary Paul, Paramus, N.J.

[21] Appl. No.: 881,098

[22] Filed: Jul. 2, 1986

[51] Int. Cl.[4] ..... G04B 19/00

[52] U.S. Cl. ..... 368/223; 368/228

[58] Field of Search ..... 368/76, 80, 88, 276, 368/285, 223, 228–234, 314

[56] References Cited

U.S. PATENT DOCUMENTS

| | | | |
|---|---|---|---|
| 619,078 | 2/1889 | Handly | 368/10 |
| 1,216,556 | 2/1917 | Faiella | 368/223 |
| 1,503,097 | 7/1924 | Daving | 368/278 |
| 2,132,051 | 11/1938 | Schuttenberg | 40/63 |
| 2,506,134 | 5/1950 | Burchell | 40/130 |
| 3,465,512 | 9/1969 | Usui et al. | 58/53 |
| 3,733,809 | 5/1973 | Reiter | 58/127 R |
| 3,817,022 | 6/1974 | Swartz | 58/50 R |
| 4,034,555 | 7/1977 | Rosenthal | 58/127 R |
| 4,253,178 | 2/1981 | Kolaczia | 368/285 |
| 4,444,513 | 4/1984 | Proellochs et al. | 368/223 |
| 4,525,077 | 6/1985 | Ketner | 368/77 |
| 4,541,727 | 9/1985 | Rosenthal | 368/232 |

*Primary Examiner*—Vit W. Miska

[57] ABSTRACT

A watch body is formed with a platform from which extends a stop and a stem, which stem includes watch hands. A rim extends along the periphery of the watch body and a transparent covering is secured to the rim and extends above the platform. A watch face is received on the platform and includes a slot through which the stem extends. The slot also cooperates with the stop to prevent movement of the watch face on the platform. At least the rim of the watch is formed with a portion which may be removed and replaced to permit insertion and removal of the watch face on the platform.

17 Claims, 11 Drawing Figures

FIG. 1
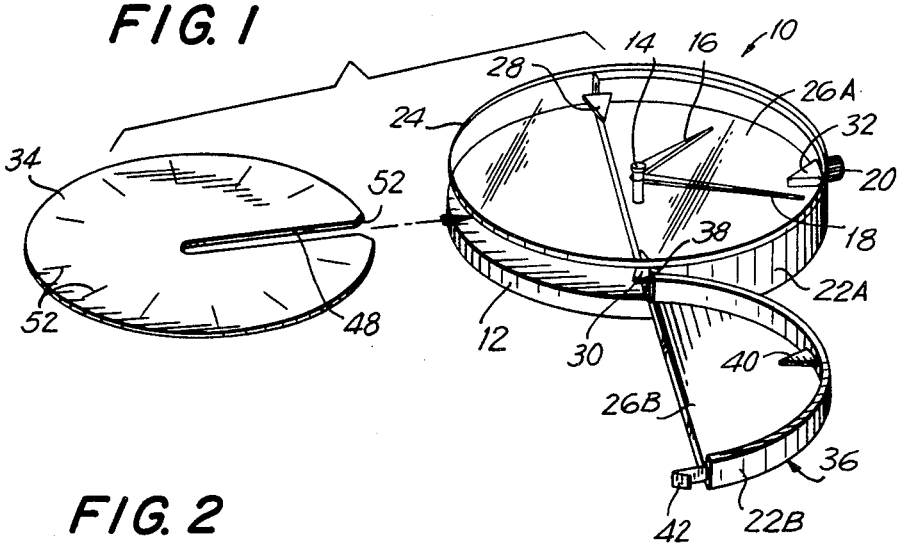
FIG. 2
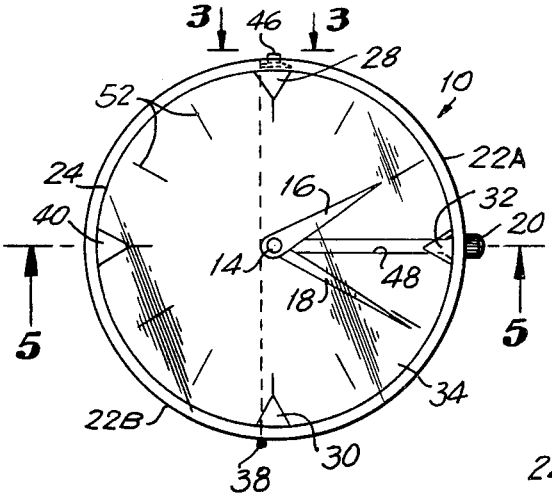
FIG. 3
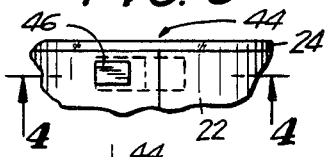
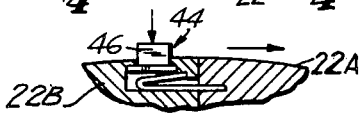
FIG. 4
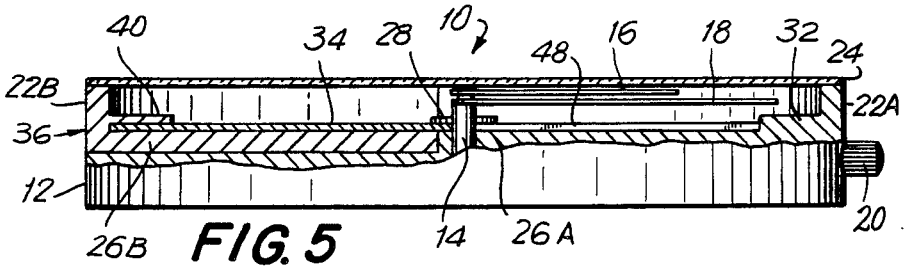
FIG. 5

FIG. 6
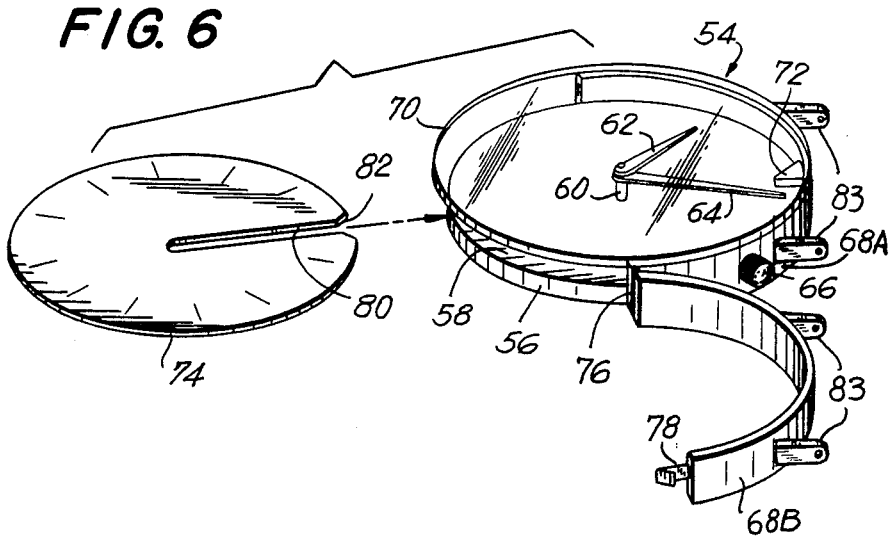
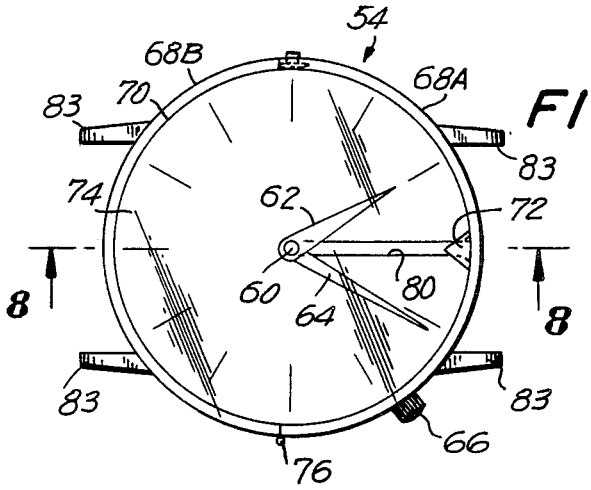
FIG. 7
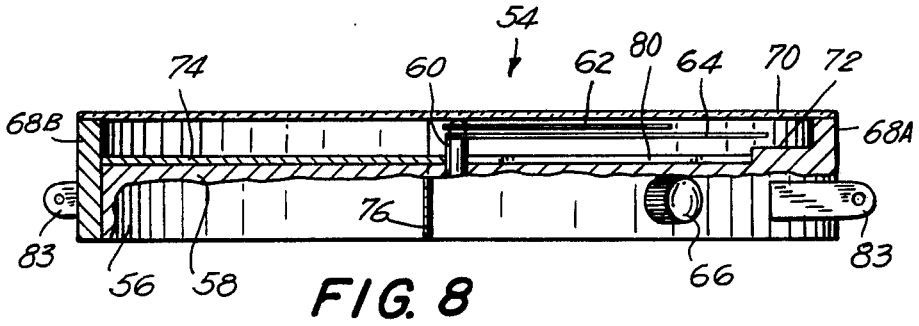
FIG. 8

FIG. 9
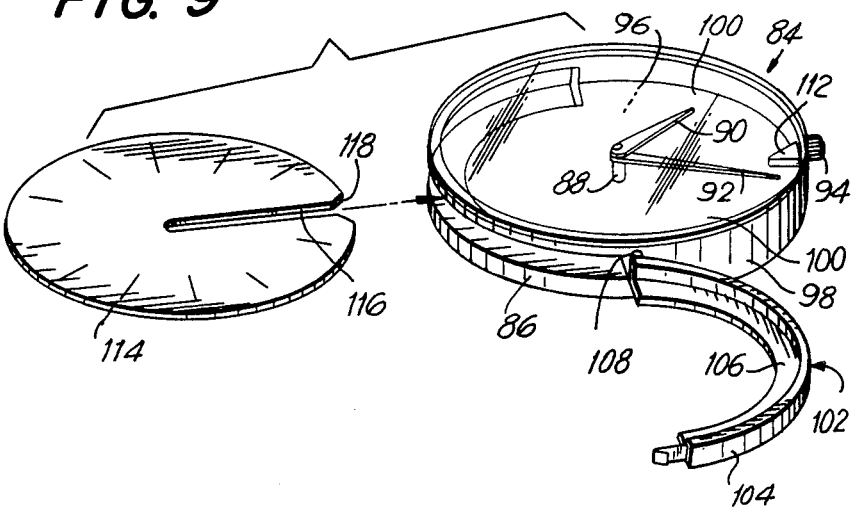
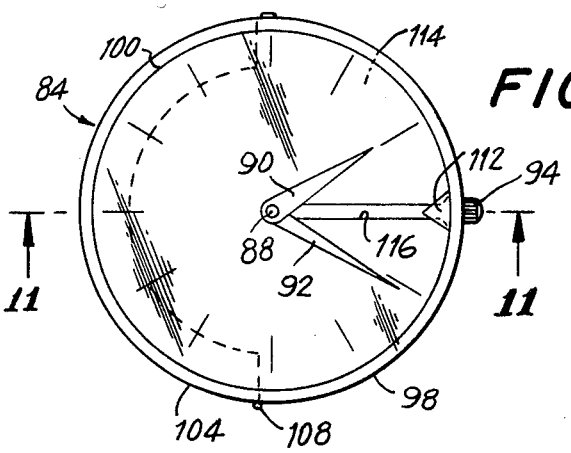
FIG. 10
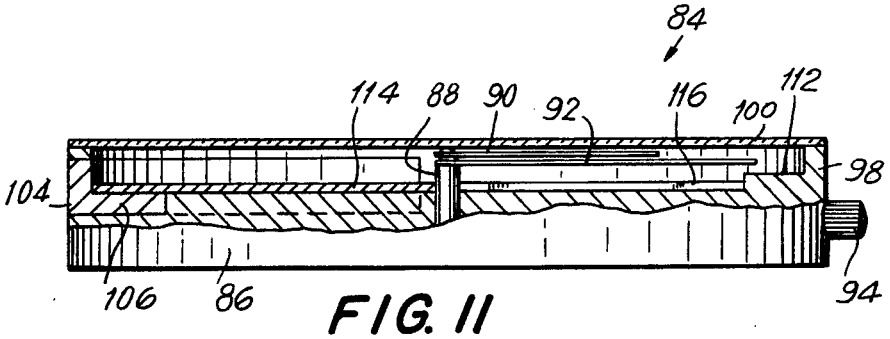
FIG. 11

WATCH WITH REMOVABLE FACE

The present invention relates to a watch with a removable face and more particularly to a watch which may be used with a plurality of different watch faces.

Timepieces, especially wristwatches, provide information, such as time, day, date, etc., and function as a fashion accessory. Wristwatches, however, are typically formed with a single permanent watch face which is not readily replaceable or removable. This is disadvantageous as it limits the versatility of the watch both from the point of view of the information which can be provided by the watch and its use as a fashion accessory.

U.S. Pat. No. 2,132,051 ("the '051 Patent"), shows a clock having a clock face formed of a plurality of memorandum pads. Each memorandum pad has a clock face printed thereon and is removable. The '051 Patent teaches that the pads may be provided with notations, such as appointments, which are related to the hourly divisions of the clock dial. The memorandum pads are formed with slots to facilitate placement around the clock hand shaft and are held in place by the use of channel rails.

Other combination clock display devices are shown in U.S. Pat. Nos. 2,506,134, 1,503,097, 1,216,556 and 619,078. These patents, as well as the '051 Patent, do not teach a simple, attractive watch with a removable and replaceable face which may be easily manufactured and which provides a highly versatile watch with respect to both fashion and information display.

Accordingly, it is an object of the present invention to provide a watch with a replaceable watch face.

Another object of the present invention is to provide a watch with a replaceable face which is simple in construction and manufacture.

Still another object of the present invention is to provide a watch with a replaceable face which is highly versatile with respect to both fashion and the display of information.

A further object of the present invention is to provide a watch with a replaceable watch face which readily permits the insertion and removal of the watch face.

In accordance with the present invention a watch body is formed with a platform from which extends a stop and a stem, the stem having watch hands. A rim extends along the periphery of the watch body and a transparent covering is secured to the rim and extends above the platform. A watch face is received on the platform and includes a slot through which the stem extends. The slot also cooperates with the stop to prevent movement of the watch face on the platform. At least the rim of the watch is formed with a portion which may be removed and replaced to permit insertion and removal of the watch face on the platform.

Other objects and features of the present invention will become apparent from the following detailed description when taken in connection with the accompanying drawings. It is to be understood that the drawings are designed for the purposes of illustration only and are not intended as a definition of the limits of the invention.

In the drawings, wherein similar reference characters denote similar elements throughout the several figures:

FIG. 1 is an exploded perspective view of the watch of the present invention with the watch face removed;

FIG. 2 is a top plan view of the watch of the present invention with the watch face inserted;

FIG. 3 is a fragmentary rear elevational view of the watch of FIG. 2 taken along the lines 3—3 of FIG. 2;

FIG. 4 is a fragmentary sectional top plan view of the watch of FIG. 2 taken along the lines 4—4 of FIG. 3;

FIG. 5 is a fragmentary sectional front elevational view of the watch of FIG. 2 taken along the lines 5—5 of FIG. 2;

FIG. 6 is an exploded perspective view of an alternate embodiment of the watch of the present invention with the watch face removed;

FIG. 7 is a top plan view of the watch of FIG. 6, with the watch face inserted;

FIG. 8 is a fragmentary sectional front elevational view of the watch of FIG. 7 taken along the lines 8—8 of FIG. 7;

FIG. 9 is an exploded perspective view of another alternate embodiment of the watch of the present invention with the watch face removed;

FIG. 10 is a top plan view of the watch of FIG. 9 with the watch face inserted; and FIG. 11 is a fragmentary sectional front elevational view of the watch of FIG. 10, taken along the lines 11—11 of FIG. 10.

Referring now to FIGS. 1–5, a watch or clock incorporating one embodiment of the present invention is identified generally by the reference numeral 10 and may be used with a suitable watchband, not shown. The watch 10 includes a body 12 within which is housed the watch mechanism, which is conventional, and from which extends a stem 14, carrying the hand 16 and 18 of the watch 10. In addition, a knob 20 extends from the body 12 at the three o'clock position and is used to set the hands 16 and 18 to the appropriate time and to permit wind ing, if necessary. Although not shown, suitable attachment means for attaching a watch band to the watch 10 may also extend from the body 12, proximate the twelve and six o'clock positions.

Body 12 is formed with a generally semicircular rim 22A which extends upwardly from the body 12 and supports a circular piece of glass or crystal 24 along generally one half of its periphery. Contained within the semicircular rim 22A and extending upwardly from the body 12 is a generally semicircular platform 26A through which the stem 14 extends.

A pair of tabs 28 and 30, which may be triangular in shape, extend from the semicircular rim 22A at, for example, the twelve o'clock and six o'clock positions, respectively. The tabs 28 and 30 extend above the semicircular platform 26A such that a predetermined spacing X is created between the tabs and the platform. A stop 32, also shown as triangular in shape, extends upwardly from the platform 26A and inwardly from the rim 22A at, for example, the three o'clock position. The stop 32 is not spaced from the platform 26A, as are tabs 28 and 30, but extends upwardly by therefrom. The stop 32 may incorporate a display, not shown, showing day of the week or date. As will be more fully described hereinbelow the tabs 28 and 30 and stop 32 are used in combination to accurately position a replaceable watch face 34 within the watch 10 and to maintain the watch face 34 in position.

A semmicircular rim and platform assembly 36 made up of a generally semicircular rim 22B and platform 26B is rotatably mounted to the rim 22A of the watch 10 by any suitable means, such as a hinge 38. The rim and platform assembly 36 may be moved between an open and a closed position; the open position being shown in FIG. 1 and the closed position shown in FIGS. 2–5.

When the assembly 36 is moved into its closed position, the rim 22B and the platform 26B are in mating relationship with the rim 22A and platform 26A of the watch 10. In this manner, a complete circular platform 26 and a complete circular rim 22 is created. The upper surface of the rim 22B of the assembly 36 provides support for the circular glass piece 24 and also includes a fourth triangular tab 40 located, for example, at the nine o'clock position. The tab 40 extends above the platform 26B such that a predetermined spacing X is created between the tab 40 and the platform 26.

Assembly 36 also includes the hook or male portion 42 of a conventional clasp assembly, similar to those used in connection with fine jewelry. As best seen in FIGS. 3 and 4, the female portion 44 of the clasp assembly is located in the rim 22A and platform 26A of the body 12 and serves to receive and hold the male portion 42, thereby locking the assembly 36 in its closed position. The female portion 44 includes a push button 46 which, in a conventional manner, may be pressed to release (unlock) the male portion 42, thereby permitting the assembly 36 to be moved to its open position.

As best seen in FIG. 1, the watch face 34 is a generally circular shaped disc which includes a radially extending slot 48 which extends from the three o'clock position to the approximate center of the watch face 34. The slot 48 is sized so as to permit the stem 14 of the watch 10 to move freely therethrough. In addition, the mouth 50 of the slot is widened and is generally triangular in shape. The thickness of the watch face 34 is just less than the distance X between the triangular tabs 28, 30 and 40 and the platform 26, such that the watch face may be placed between the tabs 28, 30 and 40 and the platform 26. The watch face 34 may have any design or information thereon and may or may not include indicia 52. It will be readily appreciated that the watch 10 may be used with a plurality of different watch faces 34 thereby providing a highly versatile watch. For example, watch faces of different colors and different designs could be utilized for the sake of fashion. However, watch faces having pictures, medical emergency information and advertising information could also be used.

When the assembly 36 is in its open position insertion and removal of the watch face 34 from the watch 10 may be accomplished. The slot 48 is aligned with the stem 14 and the watch face is simply inserted into the watch 10 along the platform 26A and beneath the triangular tabs 28 and 30. As the watch face 34 is moved into position, the stem 14 moves through the slot 48 and eventually the open end 50 of the slot comes to rest against the sides of the triangular stop 32. It will be readily appreciated that the triangular stop 32 and the open end 50 of the slot 48 cooperate to prevent rotary movement of the watch face 34 on the platform 26 around the stem 14. In addition, the triangular tabs 28 and 30, as well as the tab 40, prevent movement of the watch face 34 towards the glass piece 24 and serve to keep it flat against the platform 26.

Once the watch face 34 is completely inserted within the watch 10, the assembly 36 may be moved into its closed position, in which the platform 26B moves underneath the watch face 34 and mates with the platform 26A, the rim 22B surrounds the perimeter of watch face 34 and mates with the rim 22A and the tab 40 extends above the watch face 34 and serves to secure the watch face against the platform 26 (See FIGS. 2 and 5). When the assembly 36 is in its fully closed position, the male portion 42 of the clasp assembly enters the female portion 44 to lock the assembly 36 into its closed position, resulting in an assembled watch 10 having a particular watch face 34.

If a different watch face 34 is desired, the assembly 36 may be moved to its open position by pressing the button 46 and the watch face 34 may then be removed and replaced with another watch face.

Referring now to FIGS. 6–8, an alternate embodiment of the watch with removable face of the present invention is shown. A watch, indicated generally by the reference character 54, includes a body 56 which contains a conventional watch mechanism. The body 56 is formed with a platform 58 and a stem 60 from which the watch hands 62 and 64 extend. A knob 66 extends from the periphery of the watch body 56 and may be used to set the time and, if necessary, for winding. A semicircular rim 68A surrounds generally one-half of the outer periphery of the watch body 56 and supports a glass or crystal piece 70 which extends over the platform 58. A triangular stop 72 extends upwardly from the platform 58 of the watch body 56 at, for example, the twelve o'clock position and is used to prevent movement of and accurately position a watch face 74. The watch face 74 is formed with a slot 80 having a triangular shaped opening 82.

A semicircular rim 68B is rotatably connected to rim 68A by any suitable means, such as a hinge 76. The rim 68B is movable between an open position (shown in FIG. 6) and a closed position (shown in FIGS. 7 and 8) and includes the male portion 78 of a conventional clamp, which is received in a female portion located in the rim 68A, to lock the rim 68B in its closed position. Rims 68A and 68B are each formed with a pair of posts 83 for use in securing a watchband, now shown, to the watch 54. The watch 54 may also include one or more tabs similar to those shown in FIGS. 1–5 and identified by the reference numerals 28, 30 and 40. For example, the watch 54 could include a single tab extending from the rim 68B at about the six o'clock position.

The embodiment shown in FIGS. 6–8 differs from that shown in FIGS. 1–5 in that the platform 58 is wholly contained on the watch body 56 and only the watch rim 68 is formed in separate pieces, 68A and 68B. In addition, the stop 72 is located at the twelve o'clock position and the knob 66 is located between the twelve and three o'clock positions.

Referring now to FIGS. 9–10 another alternate embodiment of the watch with a replaceable watch face is shown. A watch, indicated generally by the reference character 84, is formed with a watch body 86 which includes a watch mechanism. A stem 88, having hands 90 and 92, and a knob 94 extend from the watch body 86, which also includes a platform 96. Although not shown, suitable attachment means for attaching a watch band to the watch 84 may extend from the body 86, proximate the twelve and six o'clock positions. The platform 96 is generally circular in shape but has a C-shaped portion removed. A rim 98 extends upwardly from the watch body 86 and completely surrounds the periphery thereof. The rim 98 supports a circular glass piece or crystal 100 along its entire circumference. The rim 98 also has a C-shaped portion removed.

A rim and platform assembly 102, including a C-shaped rim portion 104 and a C-shaped platform portion 106, is rotatably connected to the rim 98 by a hinge 108. The assembly 102 is movable between an open position (shown in FIG. 9) and a closed position (shown in FIGS. 10 and 11) and includes the male portion 110 of a clasp assembly which is received in a female portion located in the rim 98. The clasp assembly serves to lock the rim and platform assembly 102 in its closed position.

A triangular stop 112 extends upwardly from the platform 96 and serves to accurately position and prevent movement of a watch face 114. The watch face 114 is formed with a slot 116 having a triangular shaped mouth 118 which abuts the stop 112 when the watch face 114 is inserted into the watch 84. The watch 54 may also include one or more tabs similar to those shown in FIGS. 1–5 and identified by the reference numerals 28, 30 and 40.

The embodiment shown in FIGS. 9–11 differs from that shown in FIGS. 1–5 in that C-shaped portions 104 and 106 of the rim 98 and platform 96 are movable between open and closed positions. In the open position a watch face 114 may be inserted or removed from the watch 84. In the closed position of the assembly 102 an assembled watch 84 having a desired watch face 34 is achieved.

As will be readily apparent to those skilled in the art, the invention may be used in other specific forms or for other purposes without departing from its spirit or central characteristics. The present embodiment is therefore to be considered as illustrative and not restrictive, the scope of the invention being indicated by the claims rather than by the foregoing description, and all embodiments which come within the range of equivalence of the claims are intended to be embraced.

We claim:

1. A watch comprising a watch body formed with a platform, a stem extending from said platform and including watch hands, a stop extending from said platform, a rim extending along the periphery of the watch body, a transparent covering secured to said rim and extending above said platform, a watch face adapted to be received on said platform, said watch face formed with a slot through which said stem extends, said slot cooperating with said stop to prevent movement of said watch face on said platform, at least said rim of said watch formed with a removable portion which may be removed to permit insertion and removal of said watch face on said platform.

2. A watch as in claim 1 in which said platform includes a removable portion which may be removed to permit insertion and removal of said watch face on said platform, said removable portion of said platform connected to said removable portion of said rim.

3. A watch as in claim 1 in which said removable portion of said rim is rotatably mounted to said rim for movement between an open and a closed position.

4. A watch as in claim 3 which further comprises means for locking said removable portion of said rim in its closed position.

5. A watch as in claim 4 in which said means for locking comprises a clasp.

6. A watch as in claim 1 which further comprises at least one tab spaced from said platform, such that said watch face may be inserted between said tab and said platform with said tab holding said watch face against said platform.

7. A watch as in claim 6 in which said at least one tab serves as an indicia.

8. A watch as in claim 6 in which said at least one tab extends from said rim.

9. A watch as in claim 1 which includes attachment means for use in attaching a watch band to said watch body.

10. A watch comprising a watch body formed with a platform, a stem extending from said platform and including watch hands, a stop extending from said platform, a rim extending along the periphery of the watch body, a transparent covering secured to said rim and extending above said platform, a watch face adapted to be received on said platform, said watch face formed with a slot through which said stem extends, said slot cooperating with said stop to prevent movement of said watch face on said platform, at least said rim of said watch formed with a removable portion, said removable portion of said rim rotatably mounted to said watch for movement between an open position in which insertion and removal of the watch face on the platform is permitted and a closed position in which insertion and removal of said watch face on said platform is not permitted.

11. A watch as in claim 10 in which further comprises means for locking said removable portion of said rim in its closed position.

12. A watch as in claim 11 in which said means for locking comrises a clasp.

13. A watch as in claim 10 which further comprises at least one tab spaced from said platform, such that when said watch face is inserted between said tab and said platform said tab holds said watch face against said platform.

14. A watch as in claim 13 in which said at least one tab serves as an indicia.

15. A watch as in claim 13 in which said at least one tab extends from said rim.

16. A watch as in claim 10 in which said platform includes a removable portion which may be removed to permit insertion and removal of said watch face on said platform, said removable portion of said platform connected to said removable portion of said rim.

17. A watch as in claim 10 which includes attachment means for use in attaching a watch band to said watch body.

* * * * *